US009523937B2

(12) United States Patent
Tsujihiro et al.

(10) Patent No.: US 9,523,937 B2
(45) Date of Patent: Dec. 20, 2016

(54) ELECTROSTATIC LATENT IMAGE DEVELOPING TONER

(71) Applicant: KYOCERA Document Solutions Inc., Osaka (JP)

(72) Inventors: Masami Tsujihiro, Osaka (JP); Ryota Kobayashi, Osaka (JP); Hideharu Hori, Osaka (JP); Yusuke Washino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/978,356

(22) Filed: Dec. 22, 2015

(65) Prior Publication Data

US 2016/0187796 A1 Jun. 30, 2016

(30) Foreign Application Priority Data

Dec. 25, 2014 (JP) ..... 2014-263260

(51) Int. Cl.
*G03G 9/093* (2006.01)

(52) U.S. Cl.
CPC ..... *G03G 9/09328* (2013.01); *G03G 9/09321* (2013.01)

(58) Field of Classification Search
CPC ..... G03G 9/0964
See application file for complete search history.

(56) References Cited

U.S. PATENT DOCUMENTS 4,980,257 A 12/1990 Anno et al.
6,326,117 B1 * 12/2001 Ishihara ..... G03G 9/093 430/109.1
2005/0271964 A1 12/2005 Etou et al.

FOREIGN PATENT DOCUMENTS

JP H02-000880 A 1/1990
JP H06-170214 A 6/1994
JP 2004-138985 A 5/2004
JP 2006-276069 A 10/2006
JP 2014-048341 A 3/2014

OTHER PUBLICATIONS

An Office Action; "Notification of Reasons for Refusal" issued by the Japanese Patent Office on Jul. 12, 2016, which corresponds to Japanese Patent Application No. 2014-263260 and is related to U.S. Appl. No. 14/978,356; with English language translation.

* cited by examiner

*Primary Examiner* — Hoa V Le
(74) *Attorney, Agent, or Firm* — Studebaker & Brackett PC

(57) ABSTRACT

An electrostatic latent image developing toner includes toner particles that each include a toner core and a shell layer disposed over a surface of the toner core. The shell layer contains a first shell resin and a second shell resin. The first shell resin is a hydrophilic thermoplastic resin, a hydrophobic thermoplastic resin, or a hydrophobic thermosetting resin. The second shell resin is a hydrophilic thermosetting resin. The first shell resin includes a repeating unit having an alcoholic hydroxyl group.

6 Claims, 9 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2014-263260, filed on Dec. 25, 2014. The contents of this application are incorporated herein by reference in their entirety.

BACKGROUND

The present disclosure relates to an electrostatic latent image developing toner.

A toner that has favorable fixability even when heating thereof by a fixing roller is kept at a minimal level is preferable in terms of energy efficiency and device miniaturization. A toner having excellent low-temperature fixability is typically prepared using a binder resin having a low melting point or glass transition point, or using a releasing agent having a low melting point. However, a toner such as described above tends to suffer from a problem of the toner particles included therein aggregating when the toner is stored at high temperatures. In a situation in which toner particles aggregate, the aggregated toner particles tend to have a lower charge than other toner particles that are not aggregated A toner including toner particles that have a core-shell structure may be used in order to achieve an objective of obtaining a toner with excellent low-temperature fixability and high-temperature stability. For example, a toner has been proposed that includes toner particles in which the surfaces of toner cores are coated by thin films containing a hydrophilic thermosetting resin and in which the toner cores have a softening temperature of at least 40° C. and no greater than 150° C.

SUMMARY

An electrostatic latent image developing toner according to the present disclosure includes toner particles that each include a toner core and a shell layer disposed over a surface of the toner core. The shell layer contains a first shell resin and a second shell resin. The first shell resin is a hydrophilic thermoplastic resin, a hydrophobic thermoplastic resin, or a hydrophobic thermosetting resin. The second shell resin is a hydrophilic thermosetting resin. The first shell resin includes a repeating unit that has an alcoholic hydroxyl group.

Another electrostatic latent image developing toner according to the present disclosure includes toner particles that each include a toner core and a shell layer disposed over a surface of the toner core. The shell layer contains a first shell resin and a second shell resin. The first shell resin is a hydrophilic thermoplastic resin, a hydrophobic thermoplastic resin, or a hydrophobic thermosetting resin. The second shell resin is a hydrophilic thermosetting resin. In the shell layer, the first shell resin and the second shell resin are in a reacted state through a transesterification reaction or an etherification reaction.

DETAILED DESCRIPTION

Figure 1:
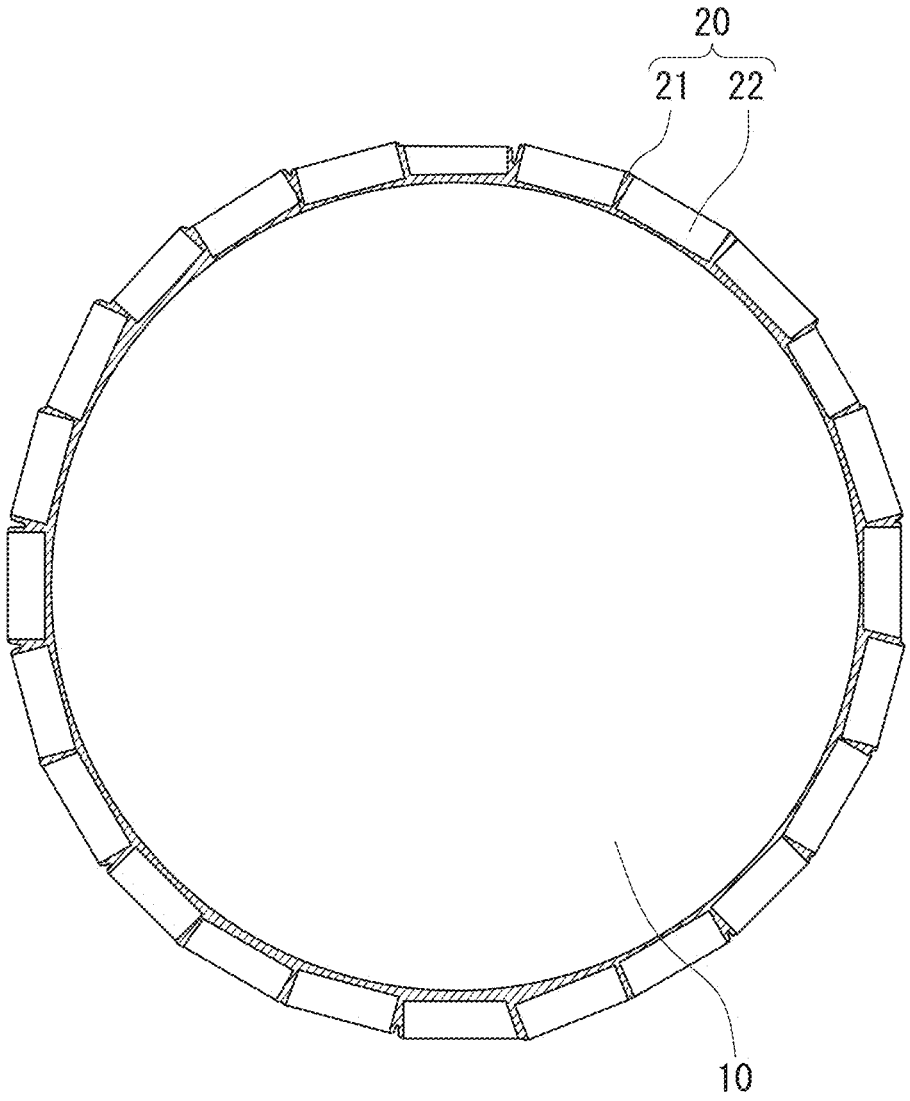
FIG. 1 illustrates an example of a toner particle included in a toner according to an embodiment of the present disclosure.

The following explains an embodiment of the present disclosure. Unless otherwise stated, evaluation results (for example, values indicating shape and physical properties) for a powder (specific examples include toner cores, toner mother particles, external additive, and toner) are number averages of values measured for a suitable number of particles that are selected as average particles within the powder. Also, unless otherwise stated, the number average particle size of a powder is the diameter of a representative circle of a primary particle (i.e., the diameter of a circle having the same surface area as a projection of the particle) measured using a microscope. In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acrylic acid" is used as a generic term for both acrylic acid and methacrylic acid.

A toner according to the present embodiment is an electrostatic latent image developing toner. The toner according to the present embodiment is a powder formed by a large number of toner particles. The toner according to the present embodiment can be used, for example, in an electrophotographic apparatus (image forming apparatus).

The following explains an example of a method by which an electrophotographic apparatus forms an image. First, an electrostatic latent image is formed on a photosensitive member based on image data. Next, the formed electrostatic latent image is developed using a two-component developer that includes a carrier and a toner. In the development process, charged toner is caused to adhere to the electrostatic latent image such that a toner image is formed on the photosensitive member. In a subsequent transfer process, the toner image on the photosensitive member is transferred onto a transfer belt and thereafter the toner image on the transfer belt is transferred onto a recording medium (for example, paper). After transfer, the toner is heated in order to fix the toner to the recording medium. Through the method described above, an image is formed on the recording medium. A full-color image can for example be formed by superposing toner images of four different colors: black, yellow, magenta, and cyan.

The toner according to the present embodiment has the following features (1) and (2-1).

(1) The toner includes toner particles that each include a toner core and a shell layer disposed over the surface of the toner core.

(2-1) The shell layers contain a first shell resin and a second shell resin. The first shell resin is a hydrophilic thermoplastic resin, a hydrophobic thermoplastic resin, or a hydrophobic thermosetting resin. The second shell resin is a hydrophilic thermosetting resin. The first shell resin includes a repeating unit that has an alcoholic hydroxyl group.

Feature (1) effectively improves high-temperature preservability of the toner. More specifically, the shell layers that coat the toner cores are thought to improve the high-temperature preservability of the toner.

Feature (2-1) effectively improves durability and low-temperature fixability of the toner. More specifically, in the toner having features (1) and (2-1), bonding between the first shell resin and the second shell resin is thought to be facilitated via the repeating unit of the first shell resin that has the alcoholic hydroxyl group. Furthermore, compatibility of the first shell resin and the second shell resin is thought to be improved by facilitating bonding between the first shell resin and the second shell resin. Improved compatibility of the first shell resin and the second shell resin in the shell layers tends to facilitate formation of shell layers having excellent durability and low-temperature fixability on the surfaces of the toner cores.

It should be noted that durability and low-temperature fixability of the toner according to the present embodiment is also thought to be improved in a situation in which the toner has the following feature (2-2) instead of, or in addition to, feature (2-1).

(2-2) The shell layers contain a first shell resin and a second shell resin. The first shell resin is a hydrophilic thermoplastic resin, a hydrophobic thermoplastic resin, or a hydrophobic thermosetting resin. The second shell resin is a hydrophilic thermosetting resin. In the shell layers, the first shell resin and the second shell resin are in a reacted state through a transesterification reaction or an etherification reaction.

Feature (2-2) improves durability and low-temperature fixability of the toner. More specifically, in the toner having features (1) and (2-2), reaction of the first shell resin and the second shell resin through a transesterification reaction or an etherification reaction is thought to improve compatibility of the first shell resin and the second shell resin. Improved compatibility of the first shell resin and the second shell resin in the shell layers tends to facilitate formation of shell layers having excellent durability and low-temperature fixability on the surfaces of the toner cores.

In the following description, features (2-1) and (2-2) may each be referred to as feature (2) in instances where it is not necessary to distinguish between features (2-1) and (2-2).

The toner according to the present embodiment includes toner particles having features (1) and (2) (also referred to below as toner particles according to the present embodiment). The toner including the toner particles according to the present embodiment has excellent high-temperature preservability, low-temperature fixability, and durability (refer to Table 3 shown further below). The toner is preferably composed of at least 80% by mass of the toner particles according to the present embodiment, more preferably at least 90/% by mass of the toner particles according to the present embodiment, and particularly preferably 100% by mass of the toner particles according to the present embodiment.

In order to further improve both low-temperature fixability and high-temperature preservability of the electrostatic latent image developing toner, the toner for example preferably has the following feature (3) in addition to features (1) and (2).

(3) In the shell layers, blocks substantially composed of a hydrophobic thermoplastic resin (first shell resin) are connected to one another via a junction portion substantially composed of a hydrophilic thermosetting resin (second shell resin). An additive may be dispersed in the hydrophobic thermoplastic resin forming the blocks. Furthermore, an additive may be dispersed in the hydrophilic thermosetting resin forming the junction portion. The amount of the hydrophobic thermoplastic resin contained in the blocks is preferably at least 80% by mass relative to the total mass of the blocks, more preferably at least 90% by mass, and most preferably 100% by mass. The amount of the hydrophilic thermosetting resin contained in the junction portion is preferably at least 80% by mass relative to the total mass of the junction portions, more preferably at least 90% by mass, and most preferably 100% by mass.

Figure 2:
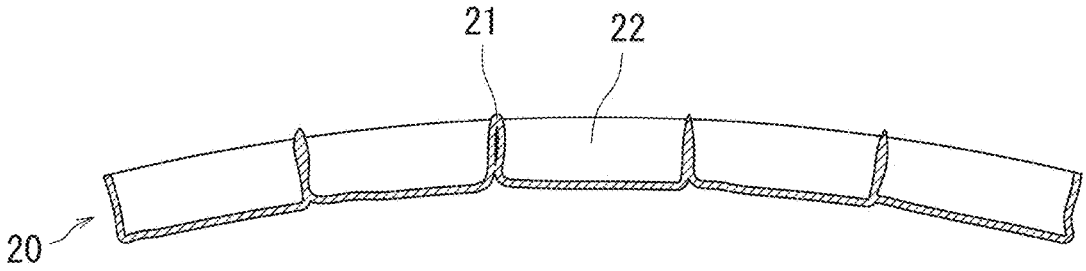
FIG. 2 illustrates an example of structure of a shell layer in a toner according to an embodiment of the present disclosure.

The following explains an example of the toner having features (1) to (3) with reference to FIGS. 1 and 2.

As illustrated in FIG. 1, a toner core 10 is coated with a shell layer 20. The shell layer 20 includes a junction portion 21 and blocks 22. The junction portion 21 is substantially composed of a hydrophilic thermosetting resin. The blocks 22 are substantially composed of a hydrophobic thermoplastic resin. In the shell layer 20, the small blocks 22 composed of the hydrophobic thermoplastic resin are formed in regions separated from one another by the junction portion 21 composed of the hydrophilic thermosetting resin. Therefore, the blocks 22 composed of the hydrophobic thermoplastic resin and the junction portion 21 composed of the hydrophilic thermosetting resin form a sea-island structure at the surface (shell layer 20) of the toner particle. The blocks 22 are exposed at the surface of the toner particle. Note that the shell layer 20 may also include blocks 22 that are not exposed at the surface of the toner particle.

FIG. 2 illustrates an example of structure of the shell layer 20 in the toner having features (1) to (3). The following provides further explanation of structure of the shell layer 20 with reference to FIGS. 1 and 2.

As illustrated in FIGS. 1 and 2, the junction portion 21 is present between the blocks 22. Each of the blocks 22 is separated from other blocks 22 by the junction portion 21 located between the blocks 22 (i.e., a wall of the junction portion 21). The junction portion 21 is also present in gaps between the blocks 22 and the toner core 10. The junction portion 21 present in the gaps between the blocks 22 and the toner core 10 (i.e., a film of the junction portion 21) connects one wall of the junction portion 21 to another wall of the junction portion 21 such that the entirety of the junction portion 21 has an integrated structure. However, the junction portion 21 is not limited to the above structure and may alternatively be divided into sections.

The hydrophobic thermoplastic resin softens upon heating to or beyond a glass transition point (Tg) thereof. However, the hydrophobic thermoplastic resin (blocks 22) is partitioned by the hydrophilic thermosetting resin (junction portion 21) in the shell layers of the toner having features (1) to (3). Therefore, the toner particles tend not to deform even if the temperature of the shell layers reaches Tg of the hydrophobic thermoplastic resin. In a toner such as described above, deformation of the toner particles only begins once heat and pressure are simultaneously applied to the toner particles. Furthermore, toner particles in such a toner are inhibited from aggregating in a state in which force is not applied to the toner. Therefore, both high-temperature preservability and low-temperature fixability of the toner having features (1) to (3) are excellent.

The toner particles each include a toner core and a shell layer disposed over the surface of the toner core. The toner cores contain a binder resin. The toner particles may include optional components (for example, one or more of a colorant, a releasing agent, a charge control agent, and a magnetic powder) in the binder resin as necessary.

An external additive may be added to the surfaces of the toner particles (toner mother particles) as necessary. In the present description, the term "toner mother particles" is used to refer to toner particles prior to treatment with an external additive. It should also be noted that a plurality of shell layers may be layered on the surface of each of the toner cores.

The toner may be used as a one-component developer. Alternatively, the toner may be mixed with a carrier to prepare a two-component developer.

[Toner Cores]

(Binder Resin)

The binder resin is typically a main component (for example, at least 85% by mass) in the toner cores. Therefore, properties of the binder resin are thought to have a large influence on overall properties of the toner cores. For example, in a situation in which the binder resin has an ester group, a hydroxyl group, an ether group, an acid group, or a methyl group, the toner cores have a stronger tendency to be anionic. On the other hand, in a situation in which the binder resin has an amino group, an amine, or an amide group, the toner cores have a stronger tendency to be cationic. In order that the binder resin is strongly anionic, the binder resin preferably has a hydroxyl value (OHV) and an acid value (AV) that are each at least 10 mg KOH/g, and more preferably each at least 20 mg KOH/g.

The binder resin preferably has at least one chemical group selected from the group consisting of an ester group, a hydroxyl group, an ether group, an acid group, and a methyl group, and more preferably has either or both of a hydroxyl group and a carboxyl group. A binder resin having a functional group such as described above readily reacts with a shell material (for example, methylol melamine) to form chemical bonds. Formation of chemical bonds between the binder resin and the shell material ensures strong bonding between the toner cores and the shell layers. Also, the binder resin preferably has a functional group including active hydrogen in molecules thereof.

The binder resin preferably has a glass transition point (Tg) that is no greater than a curing onset temperature of the shell material. It is thought that as a result of using a binder resin having Tg such as described above, fixability of the toner tends to be sufficient even during high speed fixing.

Tg of the binder resin can be measured using, for example, a differential scanning calorimeter. More specifically, Tg can be obtained from a point of change of specific heat on a heat absorption curve that is plotted by measuring a sample (i.e., the binder resin) using the differential scanning calorimeter.

The binder resin preferably has a softening point (Tm) of no greater than 100° C., and more preferably no greater than 95° C. As a result of Tm of the binder resin being no greater than 100° C., fixability of the toner tends to be sufficient even during high speed fixing. Furthermore, in a situation in which Tm of the binder resin is no greater than 100° C., partial softening of the toner cores tends to occur during a curing reaction of the shell layers when the shell layers are formed on the surfaces of the toner cores in an aqueous medium and, as a result, the toner cores tend to become round in shape due to surface tension. Tm of the binder resin can be adjusted by using a combination of resins with differing Tm as the binder resin.

Tm of the binder resin can be measured using, for example, a capillary rheometer. More specifically, melt flow of a sample (binder resin) set in the capillary rheometer is caused under specific conditions. An S-shaped curve is plotted for the binder resin. Tm of the binder resin can be read from the plotted S-shaped curve. Tm of the measurement sample (binder resin) is a temperature on the plotted S-shaped curve corresponding to a stroke value of $(S_1+S_2)/2$, where $S_1$ represents a maximum stroke value and $S_2$ represents a base line stroke value at low temperatures.

The binder resin is preferably a thermoplastic resin. Preferable examples of thermoplastic resins that can be used as the binder resin include styrene-based resins, acrylic acid-based resins, olefin-based resins (specific examples include polyethylene resin and polypropylene resin), vinyl resins (specific examples include vinyl chloride resin, polyvinyl alcohol resin, vinyl ether resin, and N-vinyl resin), polyester resins, polyamide resins, urethane resins, styrene-acrylic acid-based resins, and styrene-butadiene-based resins. Among the resins listed above, styrene-acrylic acid-based resins and polyester resins are preferable in terms of improving colorant dispersibility in the toner cores, toner chargeability, and toner fixability with respect to a recording medium.

The following explains a styrene-acrylic acid-based resin that can be used as the binder resin. The styrene-acrylic acid-based resin is a copolymer of at least one type of styrene-based monomer and at least one type of acrylic acid-based monomer.

Preferable examples of styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, alkyl (meth)acrylates, and hydroxyalkyl (meth)acrylates. Specific examples of alkyl (meth)acrylates include methyl (meth)acrylate, ethyl (meth) acrylate, n-propyl (meth)acrylate, iso-propyl (meth)acrylate, n-butyl (meth)acrylate, iso-butyl (meth)acrylate, and 2-ethylhexyl (meth)acrylate. Specific examples of hydroxyalkyl (meth)acrylates include 2-hydroxyethyl (meth)acrylate, 3-hydroxypropyl (meth)acrylate, 2-hydroxypropyl (meth) acrylate, and 4-hydroxybutyl (meth)acrylate.

A hydroxyl group can be introduced into the styrene-acrylic acid-based resin by using a monomer having a hydroxyl group (specific examples include p-hydroxystyrene, m-hydroxystyrene, and hydroxyalkyl (meth)acrylates) in preparation of the styrene-acrylic acid-based resin. The hydroxyl value of the prepared styrene-acrylic acid-based resin can be adjusted by adjusting the amount of the monomer having the hydroxyl group that is used.

A carboxyl group can be introduced into the styrene-acrylic acid-based resin by using (meth)acrylic acid (monomer) in preparation of the styrene-acrylic acid-based resin.

The acid value of the prepared styrene-acrylic acid-based resin can be adjusted by adjusting the amount of (meth) acrylic acid that is used.

In a situation in which the styrene-acrylic acid-based resin is used as the binder resin, the styrene-acrylic acid-based resin preferably has a number average molecular weight (Mn) of at least 2,000 and no greater than 3,000 in order to improve toner core strength and toner fixability. The styrene-acrylic acid-based resin preferably has a molecular weight distribution (i.e., a ratio Mw/Mn of mass average molecular weight (Mw) relative to number average molecular weight (Mn)) of at least 10 and no greater than 20. Mn and Mw of the styrene-acrylic acid-based resin can be measured by gel permeation chromatography.

The following explains a polyester resin that can be used as the binder resin. The polyester resin can be prepared through polymerization of a di-, tri-, or higher-hydric alcohol with a di-, tri-, or higher-basic carboxylic acid.

Examples of di-hydric alcohols that can be used to prepare the polyester resin include diols and bisphenols.

Preferable examples of diols that can be used include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols that can be used include bisphenol A, hydrogenated bisphenol A, bisphenol A ethylene oxide adduct, and bisphenol A propylene oxide adduct.

Examples of preferable tri- or higher-hydric alcohols that can be used to prepare the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids that can be used to prepare the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids that can be used to prepare the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (specific examples include acid halides, acid anhydrides, and lower alkyl esters) of any of the di-, tri-, or higher-basic carboxylic acids listed above may be used. In the present description, the term "lower alkyl" refers to an alkyl group having a carbon number of 1-6.

The acid value and the hydroxyl value of the polyester resin can be adjusted by adjusting the amounts of alcohol and carboxylic acid used in preparation of the polyester resin. An increase in the molecular weight of the polyester resin tends to cause a decrease in the acid value and the hydroxyl value of the polyester resin.

In a situation in which the polyester resin is used as the binder resin, the polyester resin preferably has a number average molecular weight (Mn) of at least 1,000 and no greater than 2,000 in order to improve toner core strength and toner fixability.

The polyester resin preferably has a molecular weight distribution (i.e., a ratio Mw/Mn of mass average molecular weight (Mw) relative to number average molecular weight (Mn)) of at least 9 and no greater than 21, Mn and Mw of the polyester resin can be measured by gel permeation chromatography.

(Colorant)

The toner cores may optionally contain a colorant. The colorant can be a commonly known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass.

The toner cores may optionally contain a black colorant. The black colorant may for example be carbon black. In another example, the black colorant may be a colorant that is adjusted to a black color using a yellow colorant, a magenta colorant, and a cyan colorant.

The toner cores may optionally contain a non-black colorant such as a yellow colorant, a magenta colorant, or a cyan colorant.

Examples of yellow colorants that can be used include condensed azo compounds, isoindolinone compounds, anthraquinone compounds, azo metal complexes, methine compounds, and arylamide compounds. Specific examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants that can be used include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants that can be used include copper phthalocyanine compounds, anthraquinone compounds, and basic dye lake compounds. Specific examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner cores may optionally contain a releasing agent. The releasing agent is for example used in order to improve fixability of the toner or resistance of the toner to being offset. In order to improve anionic strength of the toner cores, the toner cores are preferably prepared using an anionic wax. In order to improve toner fixability or offset resistance, the amount of the releasing agent is preferably at least 1 part by mass and no greater than 30 parts by mass relative to 100 parts by mass of the binder resin, and more preferably at least 5 parts by mass and no greater than 20 parts by mass.

Examples of preferable releasing agents include aliphatic hydrocarbon waxes (for example, low molecular weight polyethylene, low molecular weight polypropylene, polyolefin copolymer, polyolefin wax, microcrystalline wax, paraffin wax, and Fischer-Tropsch wax), oxides of aliphatic hydrocarbon waxes (for example, polyethylene oxide wax and block polymer of polyethylene oxide wax), plant waxes (for example, candelilla wax, carnauba wax, Japan wax, jojoba wax, and rice wax), animal waxes (for example, beeswax, lanolin, and spermaceti), mineral waxes (for example, ozokerite, ceresin, and petrolatum), waxes having a fatty acid ester as a main component (for example, montanic acid ester wax and castor wax), and waxes in which a fatty acid ester is partially or fully deoxidized (for example, deoxidized carnauba wax).

A compatibilizer may optionally be added to the toner cores in order to improve compatibility of the binder resin and the releasing agent.

(Charge Control Agent)

The toner cores may optionally contain a charge control agent. The charge control agent is for example used in order to improve charge stability or a charge rise characteristic of the toner. Anionic strength of the toner cores can be increased by including a negatively chargeable charge control agent in the toner cores. The charge rise characteristic of the toner is an indicator as to whether the toner can be charged to a specific charge level in a short period of time.

(Magnetic Powder)

The toner cores may optionally contain a magnetic powder. Examples of preferable magnetic powder materials that can be used include ferromagnetic metals (specific examples include iron, cobalt, and nickel), alloys of such ferromagnetic metals, ferromagnetic metal oxides (specific examples include ferrite, magnetite, and chromium dioxide) and materials subjected to ferromagnetization (specific examples include heat treatment). A single type of magnetic powder may be used or a combination of a plurality of types of magnetic powder may be used.

The magnetic powder is preferably subjected to surface treatment in order to inhibit elution of metal ions (for example, iron ions) from the magnetic powder. In a situation in which shell layers are formed on the surfaces of toner cores under acidic conditions, elution of metal ions to the surfaces of the toner cores causes the toner cores to adhere to one another more readily. Adhesion of the toner cores to one another can be inhibited by inhibiting elution of metal ions from the magnetic powder.

[Shell Layers]

The shell layers contain a first shell resin and a second shell resin. The first shell resin preferably has a functional group (for example, a hydroxyl group, a carboxyl group, an amino group, a carbodiimide group, an oxazoline group, or a glycidyl group) that readily reacts with a functional group of the second shell resin (for example, a methylol group or an amino group). The amino group may be included in the first shell resin in the form of a carbamoyl group ($—CONH_2$).

The first shell resin is a hydrophilic thermoplastic resin, a hydrophobic thermoplastic resin, or a hydrophobic thermosetting resin.

The first shell resin may for example preferably be a hydrophilic thermoplastic resin such as an acrylamide-based resin or a sodium acrylate-based resin.

An acrylamide-based resin (first shell resin) can be introduced into the shell layers using an acrylamide-based monomer such as acrylamide or methacrylamide. A sodium acrylate-based resin (first shell resin) can be introduced into the shell layers using a sodium acrylate-based monomer such as sodium acrylate or sodium methacrylate.

The first shell resin may for example preferably be a hydrophobic thermoplastic resin such as an acrylic acid-based resin, a styrene-acrylic acid-based copolymer, a silicone-acrylic acid-based graft copolymer, a urethane resin, a polyester resin, or an ethylene-vinyl alcohol copolymer, with an acrylic acid-based resin, a styrene-acrylic acid-based copolymer, or a silicone-acrylic acid-based graft copolymer being more preferable, and an acrylic acid-based resin being most preferable.

The hydrophobic thermoplastic resin (first shell resin) can be introduced into the shell layers using an acrylic acid-based monomer, examples of which include: alkyl (meth) acrylates such as methyl (meth)acrylate, ethyl (meth)acrylate, n-propyl (meth)acrylate, and n-butyl (meth)acrylate; aryl (meth)acrylates such as phenyl (meth)acrylate; hydroxyalkyl (meth)acrylates such as 2-hydroxyethyl (meth)acrylate, 3-hydroxypropyl (meth)acrylate, 2-hydroxypropyl (meth)acrylate, and 4-hydroxybutyl (meth) acrylate; (meth)acrylamide; (meth)acrylic acid ethylene oxide adduct; and alkyl ethers (for example, methyl ether, ethyl ether, n-propyl ether, or n-butyl ether) of ethylene oxide adduct of a (meth)acrylic acid ester.

The first shell resin may be a hydrophobic thermosetting resin. Such a first shell resin (hydrophobic thermosetting resin) is for example preferably a copolymer of an acrylic acid-based monomer and a divinylbenzene-based cross-linking monomer, a diallyl phthalate-based cross-linking monomer, or a dimethacrylic acid ester-based cross-linking monomer.

Examples of divinylbenzene-based cross-linking monomers that can be used to introduce the hydrophobic thermosetting resin (first shell resin) into the shell layers include o-divinylbenzene, m-divinylbenzene, and p-divinylbenzene. Examples of diallyl phthalate-based cross-linking monomers that can be used include diallyl isophthalate and diallyl orthophthalate. Examples of dimethacrylic acid ester-based cross-linking monomers that can be used include ethylene glycol dimethacrylate and triethylene glycol dimethacrylate.

The first shell resin includes a repeating unit that has an alcoholic hydroxyl group. Preferable examples of monomers that can be used to introduce the repeating unit having the alcoholic hydroxyl group into the shell layers include 2-hydroxyalkyl (meth)acrylates, with 2-hydroxyethyl acrylate (HEA), 2-hydroxypropyl acrylate (HPA), 2-hydroxyethyl methacrylate (HEMA), and 2-hydroxypropyl methacrylate being particularly preferable.

The second shell resin is a hydrophilic thermosetting resin. Preferable examples of the second shell resin (hydrophilic thermosetting resin) include melamine resins, urea resins, sulfonamide resins, glyoxal resins, guanamine resins, aniline resins, polyimide resin, and derivatives of any of the aforementioned resins. A polyimide resin includes nitrogen atoms in a molecular backbone thereof. Therefore, shell layers containing a polyimide resin tend to be strongly cationic. Examples of polyimide resins that can be used include maleimide-based polymers and bismaleimide-based polymers (specific examples include amino-bismaleimide polymer and bismaleimide-triazine polymer).

A resin produced through polycondensation of a compound having an amino group and an aldehyde (for example, formaldehyde) is particularly preferable as the second shell resin. Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

Cross-link curing by the second shell resin can be improved through inclusion of nitrogen atoms in the second shell resin. In order to increase reactivity of the second shell resin (melamine resin, urea resin, or glyoxal resin), nitrogen atoms preferably have a content of at least 40% by mass and no greater than 55% by mass in the case of a melamine resin, approximately 40% by mass in the case of a urea resin, and approximately 15% by mass in the case of a glyoxal resin.

Examples of monomers that can be used to introduce the second shell resin (hydrophilic thermosetting resin) into the shell layers include methylol melamine, benzoguanamine, acetoguanamine, spiroguanamine, and dimethylol dihydroxyethyleneurea (DMDHEU).

In a situation in which a hydrophobic thermosetting resin or a hydrophilic thermosetting resin is synthesized, a thermosetting resin can be obtained by adding a cross-linking agent to a monomer (for example, an acrylic acid-based monomer) for synthesis of a hydrophobic thermoplastic resin or a hydrophilic thermoplastic resin. Examples of cross-linking agents that can be used include aromatic divinyl compounds (specific examples include divinylbenzene and divinylnaphthalene), carboxylic acid esters having two carbon-carbon double bonds (specific examples include ethylene glycol diacrylate), divinyl compounds (specific examples include divinylaniline, divinyl ether, divinyl sulfide, and divinyl sulfone), and compounds having three or more vinyl groups.

In order to improve film quality of the shell layers, the amount of the cross-linking agent is preferably at least 0.01% by mass and no greater than 10% by mass relative to the thermosetting resin, and more preferably at least 0.1% by mass and no greater than 5% by mass.

The shell layer may have fractures (i.e., portions having low mechanical strength) therein. The fractures can for example be formed by causing localized defects to occur in the shell layers. Formation of the fractures enables the shell layers to be ruptured more easily. As a result, the toner can be fixed to a recording medium at low temperatures. Any appropriate number of fractures may be provided.

[External Additive]

An external additive may optionally be caused to adhere to the surface of the toner particles as necessary. Examples of external additives that can be used include particles of metal oxides (specific examples include alumina, titanium oxide, magnesium oxide, zinc oxide, strontium titanate, and barium titanate) and particles of silica.

The external additive preferably has a particle size of at least 0.01 μm and no greater than 1.0 μm. The amount of the external additive is preferably at least 0.5 parts by mass and no greater than 10 parts by mass relative to 100 parts by mass of the toner mother particles, and more preferably at least 1 part by mass and no greater than 5 parts by mass.

[Carrier]

The toner according to the present embodiment can be mixed with a carrier to prepare a two-component developer. A magnetic carrier is preferably used in preparation of the two-component developer.

One preferable example of a carrier is a powder of carrier particles in which carrier cores are coated by a resin. Examples of the carrier cores include: particles of iron, oxidized iron, reduced iron, magnetite, copper, silicon steel, ferrite, nickel, or cobalt; particles of an alloy of any of the above materials with a metal such as manganese, zinc, or aluminum; particles of iron-nickel alloy or iron-cobalt alloy, particles of a ceramic (specific examples include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate): and particles of a high-dielectric substance (specific examples include ammonium dihydrogen phosphate, potassium dihydrogen phosphate, or Rochelle salt). In a situation in which the carrier cores are formed by a resin, the aforementioned particles (for example, ferrite particles) may be dispersed in the resin that forms the carrier cores.

Examples of resins that can be used to coat the carrier cores include acrylic acid-based polymers, styrene-based polymers, styrene-acrylic acid-based copolymers, olefin-based polymers (specific examples include polyethylene, chlorinated polyethylene, and polypropylene), polyvinyl chloride, polyvinyl acetate, polycarbonates, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resins, and amino resins. A combination of any two or more of the above resins may be used.

The carrier preferably has a particle size, as measured using an electron microscope, of at least 20 μm and no greater than 120 μm, and more preferably at least 25 μm and no greater than 80 μm.

In a situation in which the toner and the carrier are used to prepare a two-component developer, the amount of the toner is preferably at least 3% by mass and no greater than 20% by mass relative to mass of the two-component developer, and more preferably at least 5% by mass and no greater than 15% by mass.

[Toner Manufacturing Method]

The following describes a method for manufacturing the electrostatic latent image developing toner according to the present embodiment. The method for manufacturing the electrostatic latent image developing toner according to the present embodiment includes a toner core production process and a shell layer formation process. The toner core production process involves producing toner cores. The shell layer formation process involves adding the produced toner cores, a first shell resin precursor including a monomer having a hydroxyl group, or an oligomer, polymer, etc., thereof, and a second shell resin precursor to a liquid. The shell layer formation process also involves heating the liquid to form a shell layer containing a first shell resin and a second shell resin on the surface of each of the toner cores. The first shell resin is a hydrophilic thermoplastic resin, a hydrophobic thermoplastic resin, or a hydrophobic thermosetting resin. The second shell resin is a hydrophilic thermosetting resin. The first shell resin includes a repeating unit that has an alcoholic hydroxyl group.

(Toner Core Production Process)

Examples of preferable toner core production processes include a pulverization method and an aggregation method.

In the pulverization method, a binder resin and internal additives (for example, a colorant, a releasing agent, a charge control agent, and a magnetic powder) are mixed. Next, the resultant mixture is melted and kneaded. The resultant kneaded product is subsequently pulverized. Next, the resultant pulverized product is classified. As a result, toner cores having a desired particle size are produced. The pulverization method enables relatively simple production of toner cores.

The aggregation method for example includes an aggregation step and a coalescence step. The aggregation step involves causing various types of fine particles containing components of the toner cores (for example, binder resin fine particles, colorant fine particles, and releasing agent fine particles) to aggregate in an aqueous medium to form aggregated particles. The coalescence step involves causing coalescence of the components contained in the aggregated particles to form toner cores. The aggregation method enables production of toner cores that tend to be uniform in shape and particle size.

(Shell Layer Formation Process)

The shell layer formation process involves forming shell layers on the surfaces of the toner cores. The shell layers are formed using a first shell resin precursor and a second shell resin precursor. Formation of the shell layers is preferably carried out in an aqueous medium in order to prevent dissolution of the binder resin or elution of the releasing agent. The aqueous medium is a medium in which water is a main component (specific examples include pure water and a mixture of water with a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be included in the aqueous medium include alcohols (specific examples include methanol and ethanol). The aqueous medium has a boiling point of approximately 100° C.

In the method for manufacturing the toner according to the present embodiment, the toner cores produced through the toner core production process, a first shell resin precursor including a monomer that has an alcoholic hydroxyl group, or an oligomer, polymer, etc., thereof, and a second shell resin precursor are added to a liquid (for example, an aqueous medium).

The following refers mainly to FIGS. 3-6 to explain an example of the shell layer formation process (referred to below as a first shell layer formation process) in the method of manufacturing the toner according to the present embodiment, in a situation in which a hydrophobic thermoplastic resin precursor is used as the first shell resin precursor and a hydrophilic thermosetting resin precursor is used as the second shell resin precursor. In each of FIGS. 3-6, the left-hand side illustrates shell materials prior to a polymerization reaction and the right-hand side illustrates the shell materials after the polymerization reaction.

Figure 3:
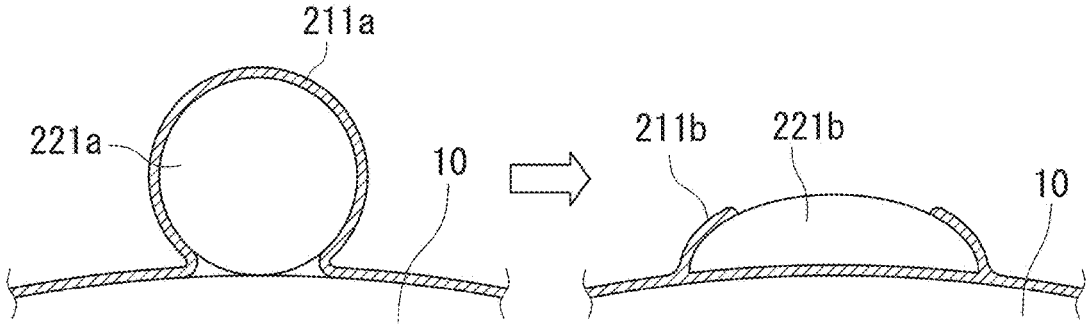
FIG. 3 illustrates a first shell layer formation process related to a method for manufacturing a toner according to an embodiment of the present disclosure.

In the first shell layer formation process, the toner cores, the hydrophilic thermosetting resin precursor, and the hydrophobic thermoplastic resin precursor including the monomer having the alcoholic hydroxyl group, or the oligomer, polymer, etc., thereof (for example, a prepolymer), are added to an aqueous medium. Through the above, particles of the hydrophobic thermoplastic resin precursor become adhered to the surfaces of the toner cores in the aqueous medium. Furthermore, the hydrophilic thermosetting resin precursor covers the surfaces of the toner cores to which the particles of the hydrophobic thermoplastic resin precursor adhere. More specifically, a film 211*a* of the hydrophilic thermosetting resin precursor and a particle 221*a* of the hydrophobic thermoplastic resin precursor form on the surface of a toner core 10 as shown in FIG. 3 (left-hand side). The film 211*a* and the particle 221*a* each adhere to the surface of the toner core 10. The hydrophobic thermoplastic resin precursor is thought to aggregate to form the particle 221*a*, rather than spreading out in the aqueous medium, due to the hydrophobicity of the precursor. Furthermore, it is thought that each particle 221*a* is surrounded by the toner core 10 and the film 211*a* such that the particle 221*a* is hardly exposed to the aqueous medium (i.e., there is little contact between the particle 221*a* and the aqueous medium).

Next, the aqueous medium (more specifically, a dispersion of toner cores 10 with films 211*a* and particles 221*a* formed thereon) is stirred while being heated to a specific temperature and then maintained at the specific temperature for a specific time. Through the above, curing of the shell materials (hydrophilic thermosetting resin precursor and hydrophobic thermoplastic resin precursor) adhering to the surface of each toner core 10 occurs through a polymerization reaction. As a result, a shell layer including a film 211*b* of the hydrophilic thermosetting resin (junction portion 21 illustrated in, for example, FIG. 1) and a particle 221*b* of the hydrophobic thermoplastic resin (block 22 illustrated in, for example. FIG. 1) is formed on the surface of the toner core 10 as illustrated in FIG. 3 (right-hand side).

The shell materials (hydrophobic thermoplastic resin precursor and hydrophilic thermosetting resin precursor) adhere to the toner cores prior to curing of the shell layers. It is thought that, as a result of the above, particles of the hydrophobic thermoplastic resin precursor do not fuse with one another at the surfaces of the toner cores, even when the shell layers are cured by heating. Furthermore, it is thought that the hydrophilic thermosetting resin precursor is present at an interface between the aqueous medium and each particle of the hydrophobic thermoplastic resin due to strong hydrophilicity of the hydrophilic thermosetting resin precursor prior to heating. However, hydrophilicity of the hydrophilic thermosetting resin precursor tends to weaken as the curing reaction of the shell layers proceeds. The above is thought to cause the hydrophilic thermosetting resin precursor to move into gaps between blocks of the hydrophobic thermoplastic resin and gaps between the blocks of the hydrophobic thermoplastic resin and the toner cores during the curing reaction of the shell layers as a result of the capillary effect.

In the method for manufacturing the toner according to the present embodiment, the hydrophobic thermoplastic resin precursor includes a monomer that has an alcoholic hydroxyl group. Therefore, bonding readily occurs between the film 211*a* of the hydrophilic thermosetting resin precursor and the particle 221*a* of the hydrophobic thermoplastic resin precursor via the monomer having the alcoholic hydroxyl group. Bonding between the film 211*a* and the particle 221*a* makes phase separation of the film 211*a* and the particle 221*a* unlikely to occur. It is thought that in a situation in which phase separation of the film 211*a* of the hydrophilic thermosetting resin precursor and the particle 221*a* of the hydrophobic thermoplastic resin precursor does not occur, the particle 221*b* is securely held by the film 211*b* after the polymerization reaction as illustrated in FIG. 3 (right-hand side).

Figure 4:
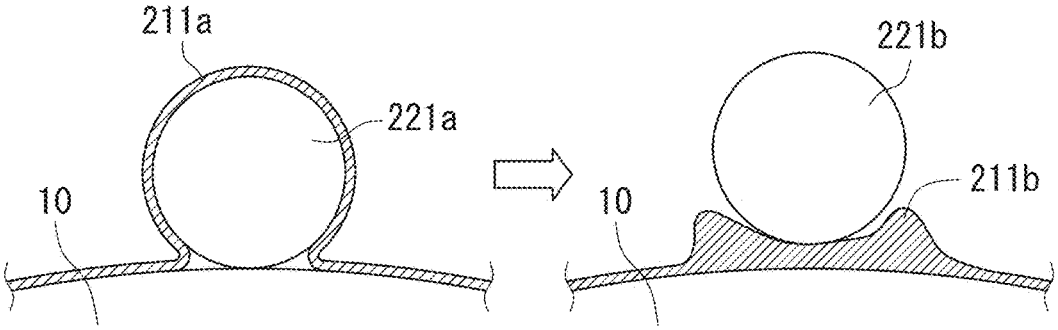
FIG. 4 Related Art
FIG. 4 illustrates a comparative example of a first shell layer formation process.

In contrast, phase separation of the film 211*a* of the hydrophilic thermosetting resin precursor and the particle 221*a* of the hydrophobic thermoplastic resin precursor may occur in the first shell layer formation process if the hydrophobic thermoplastic resin precursor does not include a monomer having an alcoholic hydroxyl group. It is thought that in a situation in which phase separation of the film 211*a* of the hydrophilic thermosetting resin precursor and the particle 221*a* of the hydrophobic thermoplastic resin precursor occurs, the particle 221*b* is not sufficiently held by the film 211*b* after the polymerization reaction as illustrated in FIG. 4 (right-hand side) and, as a result, the particle 221*b* tends to be more likely to detach from the surface of the toner core 10.

Figure 5:
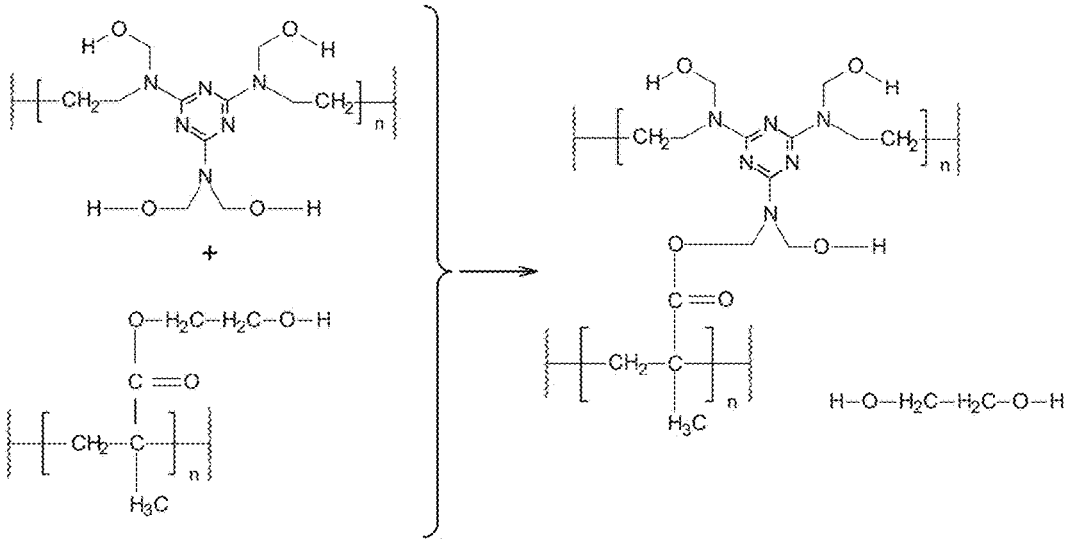
FIG. 5 illustrates an example of a transesterification reaction of a first shell resin and a second shell resin in a method for manufacturing a toner according to an embodiment of the present disclosure.
Figure 6:
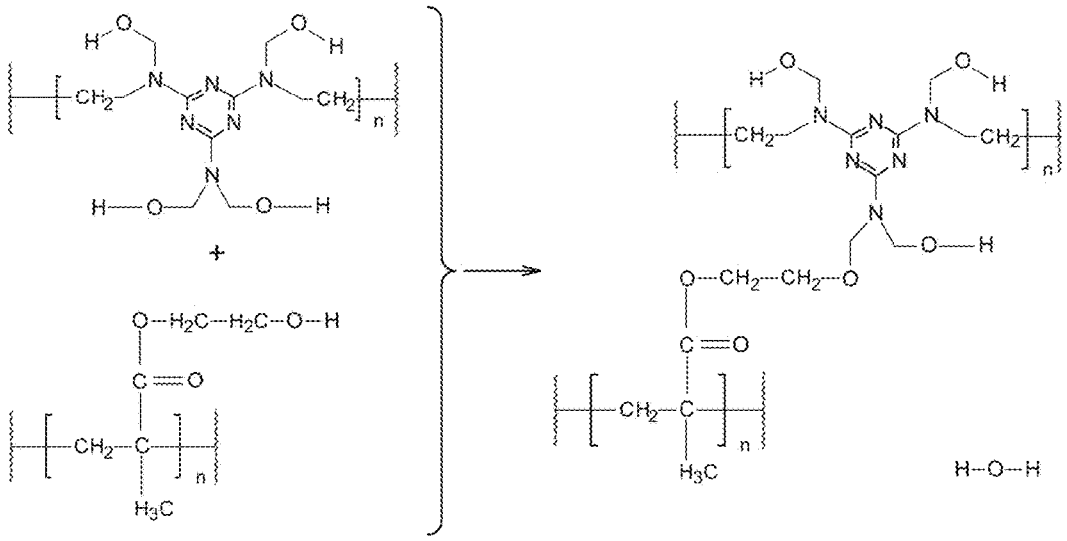
FIG. 6 illustrates an example of an etherification reaction of a first shell resin and a second shell resin in a method for manufacturing a toner according to an embodiment of the present disclosure.

Furthermore, in the first shell layer formation process, the first shell resin and the second shell resin are thought to bond more readily through a transesterification reaction or an etherification reaction as a result of the first shell resin precursor including the monomer that has the alcoholic hydroxyl group. For example, in a situation in which methylol melamine (melamine resin precursor) and a first shell resin precursor including 2-hydroxyethyl methacrylate (HEMA) are added to a liquid (for example, an aqueous medium) in the first shell layer formation process, HEMA and methylol melamine are thought to react through a transesterification reaction as illustrated in FIG. 5 or through an etherification reaction as illustrated in FIG. 6. In FIGS. 5 and 6, a repeating unit originating from HEMA is equivalent to a "repeating unit having an alcoholic hydroxyl group." In FIGS. 5 and 6, each n independently indicates the number of units of the repeating unit.

Figure 7:
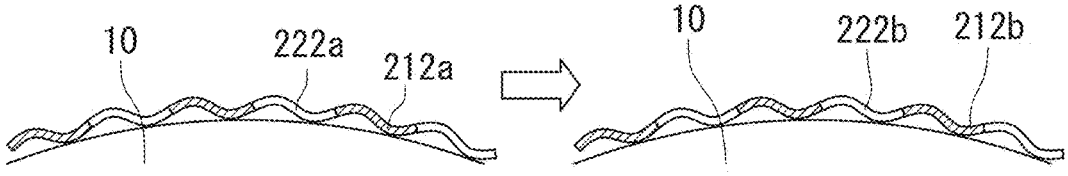
FIG. 7 illustrates a second shell layer formation process related to a method for manufacturing a toner according to an embodiment of the present disclosure.
Figure 8:
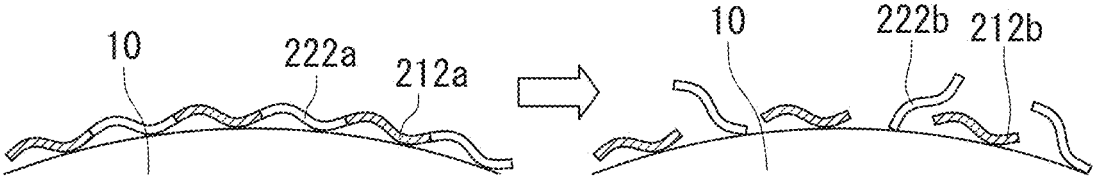
FIG. 8 Related Art
FIG. 8 illustrates a comparative example of a second shell layer formation process.

The following refers mainly to FIGS. 7 and 8 to explain an example of the shell layer formation process (referred to below as a second shell layer formation process) in the method of manufacturing the toner according to the present embodiment, in a situation in which a hydrophilic thermoplastic resin precursor is used as the first shell resin precursor and a hydrophilic thermosetting resin precursor is used as the second shell resin precursor. In each of FIGS. 7 and 8, the left-hand side illustrates shell materials prior to a polymerization reaction and the right-hand side illustrates the shell materials after the polymerization reaction.

In the second shell layer formation process, the toner cores, the hydrophilic thermosetting resin precursor, and the hydrophilic thermoplastic resin precursor including the monomer having the alcoholic hydroxyl group, or the oligomer, polymer, etc., thereof (for example, a prepolymer), are added to an aqueous medium. Through the above, a film 212*a* of the hydrophilic thermosetting resin precursor and a film 222*a* of the hydrophilic thermoplastic resin are formed on the surface of a toner core 10 in the aqueous medium as illustrated in FIG. 7 (left-hand side).

Next, the aqueous medium (more specifically, a dispersion of toner cores 10 with films 212*a* and films 222*a* formed thereon) is stirred while being heated to a specific temperature and then maintained at the specific temperature for a specific time. Through the above, curing of the shell materials (hydrophilic thermosetting resin precursor and hydrophilic thermoplastic resin precursor) adhering to the surface of each toner core 10 occurs through a polymerization reaction. The film 212*a* of the hydrophilic thermosetting resin precursor and the film 222*a* of the hydrophilic thermoplastic resin precursor become connected to one another during the polymerization reaction of the shell materials. As a result, a shell layer including a film 212*b* of the hydrophilic thermosetting resin and a film 222*b* of the hydrophilic thermoplastic resin is formed on the surface of the toner core 10 as illustrated in FIG. 7 (right-hand side). Due to the hydrophilic thermoplastic resin precursor including the monomer having the alcoholic hydroxyl group, the film 212*b* and the film 222*b* tend to easily bond to one another via a repeating unit having the alcoholic hydroxyl group. The above is thought to result in formation of shell layers that have high durability.

In contrast, phase separation of the film 212*a* of the hydrophilic thermosetting resin precursor and the film 222*a* of the hydrophilic thermoplastic resin precursor may occur in the second shell layer formation process if the hydrophilic thermoplastic resin precursor does not include a monomer having an alcoholic hydroxyl group. In a situation in which phase separation of the film 212*a* and the film 222*a* occurs, it is thought that the film 212*b* of the hydrophilic thermosetting resin and the film 222*b* of the hydrophilic thermoplastic resin separate after the polymerization reaction as illustrated in FIG. 8 (right-hand side), and, as a result, the film 212*b* or the film 222*b* tends to more readily detach from the surface of the toner core 10.

The pH of the aqueous medium is preferably adjusted to approximately 4 using an acidic substance prior to addition of the materials for forming the shell layers. Adjustment of the aqueous medium to an acidic pH promotes the polymerization reaction by which the shell layers are formed.

In order that formation of the shell layers proceeds favorably, the shell layers are preferably formed on the surfaces of the toner cores at a temperature of at least 40° C. and no greater than 95° C., and more preferably at least 50° C. and no greater than 80° C.

Formation of the shell layers on the surfaces of the toner cores as described above yields a dispersion of toner mother particles. Next, the resultant dispersion of toner mother particles is cooled to room temperature. Thereafter, toner is prepared by carrying out, as necessary, a step of washing the toner mother particles (washing step), a step of drying the toner mother particles (drying step), and a step of causing an external additive to adhere to the surfaces of the toner mother particles (external addition step).

The washing step involves washing the toner mother particles using water. Preferable washing methods include a method involving collecting a wet cake of the toner mother particles from the dispersion of toner mother particles by solid-liquid separation and washing the collected wet cake of toner mother particles using water, and a method involving causing sedimentation of the toner mother particles in the dispersion, exchanging a supernatant with water, and subsequently re-dispersing the toner mother particles in the water.

The drying step involves drying the toner mother particles. Preferable examples of methods for drying the toner mother particles include use of a dryer (more specifically, a spray dryer, a fluidized bed dryer, a vacuum freeze dryer, or a reduced pressure dryer). Use of a spray dryer is preferable in terms of inhibiting aggregation of the toner mother particles during drying. The spray dryer can be used to cause an external additive, such as silica particles, to adhere to the surfaces of the toner mother particles by spraying a dispersion of the external additive with the toner mother particles.

The external addition step involves causing an external additive to adhere to the surfaces of the toner mother particles. Preferable example of methods for causing adhesion of the external additive include a method involving using a mixer (specific examples include an FM mixer and a Nauta mixer (registered Japanese trademark)) to mix the toner mother particles and the external additive under conditions such that the external additive does not become embedded in the surfaces of the toner mother particles.

The toner manufacturing method described above may be altered as appropriate in accordance with requirements of the toner, such as in terms of composition and properties. For example, the materials of the shell layers may be dissolved in a solvent prior to addition of the toner cores to the solvent. Alternatively, the toner cores may be added to a solvent prior to dissolving the materials of the shell layers in the solvent. The shell layers may be formed by any appropriate process. The shell layers may for example be formed through any of an in-situ polymerization process, an in-liquid curing coating process, or a coacervation process. Various steps may be omitted as appropriate depending on the intended use of the toner. In a situation in which an external additive is not caused to adhere to the surfaces of the toner mother particles (i.e., the external addition step is omitted), the toner mother particles and the toner particles are equivalent. In order to efficiently manufacture the toner, preferably a large number of toner particles are formed at the same time.

EXAMPLES

The following explains Examples of the present disclosure. Table 1 shows details of toners (electrostatic latent image developing toners) of Examples 1-18 and Comparative Examples 1-3. Table 2 shows details of first shell resin precursors A-1 to A-7, B-1 to B-4, and C-1 to C4 used to prepare the aforementioned toners.

TABLE 1

| | First shell resin | | | | Second shell resin | |
|---|---|---|---|---|---|---|
| | Precursor | Properties | Particle size [nm] | Amount [mL] | Properties | Amount [mL] |
| Example 1 | A-1 | Hydrophobic Thermosetting | 32 | 150 | Hydrophilic Thermosetting | 0.10 |
| Example 2 | | | 32 | | | 0.05 |
| Example 3 | | | 32 | | | 0.50 |
| Example 4 | A-2 | | 39 | | | 0.10 |
| Example 5 | A-3 | | 24 | | | 0.10 |
| Example 6 | A-4 | | 34 | | | 0.10 |
| Example 7 | A-5 | | 32 | | | 0.10 |
| Example 8 | A-6 | | 43 | | | 0.10 |
| Example 9 | B-1 | Hydrophilic Thermoplastic | — | 150 | Hydrophilic Thermosetting | 0.10 |
| Example 10 | | | — | | | 0.05 |
| Example 11 | | | — | | | 0.50 |
| Example 12 | B-2 | | — | | | 0.50 |
| Example 13 | B-3 | | — | | | 0.50 |
| Example 14 | C-1 | Hydrophobic Thermoplastic | 39 | 150 | Hydrophilic Thermosetting | 0.10 |
| Example 15 | | | 39 | | | 0.05 |
| Example 16 | | | 39 | | | 0.50 |
| Example 17 | C-2 | | 32 | | | 0.50 |
| Example 18 | C-3 | | 41 | | | 0.50 |
| Comparative Example 1 | A-7 | Hydrophobic Thermosetting | 45 | 150 | Hydrophilic Thermosetting | 0.10 |
| Comparative Example 2 | B-4 | Hydrophilic Thermoplastic | — | | | 0.10 |
| Comparative Example 3 | C-4 | Hydrophobic Thermoplastic | 40 | | | 0.10 |

TABLE 2

| First shell resin precursor | Monomer having alcoholic hydroxyl group Type | Amount [mL] | Styrene [mL] | Acrylamide [mL] | Butyl acrylate [mL] | Cross-linking agent [mL] |
|---|---|---|---|---|---|---|
| A-1 | HEMA | 4 | 14 | — | 2 | 0.5 |
| A-2 | | 1 | 17 | — | | |
| A-3 | | 10 | 8 | — | | |
| A-4 | HEA | 4 | 15 | — | 1 | |
| A-5 | HPA | 4 | 15 | — | 1 | |
| A-6 | HPMA | 4 | 15 | — | 3 | |
| A-7 | — | — | 20 | — | 2 | |
| B-1 | HEMA | 8 | — | 12 | — | — |
| B-2 | | 6 | — | 14 | — | — |
| B-3 | | 10 | — | 10 | — | — |
| B-4 | — | — | — | 20 | — | — |
| C-1 | HEMA | 4 | 14 | — | 2 | — |

TABLE 2-continued

| First shell resin precursor | Monomer having alcoholic hydroxyl group Type | Amount [mL] | Styrene [mL] | Acrylamide [mL] | Butyl acrylate [mL] | Cross-linking agent [mL] |
|---|---|---|---|---|---|---|
| C-2 | | 1 | 17 | — | | — |
| C-3 | | 10 | 8 | — | | — |
| C-4 | — | — | 18 | — | | — |

(Preparation of Suspension of First Shell Resin Precursor A-1)

First, 875 mL of ion exchanged water and 75 mL of an anionic surfactant (LATEMUL WX produced by Kao Corporation, sodium polyoxyethylene alkyl ether sulfate) were added into a three-necked flask equipped with a thermometer and a stirring impeller, and having a capacity of 1 L. The internal temperature of the flask was subsequently increased to 80° C. using a water bath. Thereafter, a mixture of 14 mL of styrene, 4 mL of 2-hydroxyethyl methacrylate (HEMA), 2 mL of butyl acrylate, and 0.5 mL of divinylbenzene and, separately thereto, a solution of 0.5 g of potassium persulfate dissolved in 30 mL of ion exchanged water were dripped into the flask over 5 hours. The flask contents were maintained at 80° C. for 2 hours in order to allow polymerization of polymerizable monomers added to the flask. As a result, a suspension of a first shell resin precursor A-1 was prepared. Particles of the first shell resin precursor A-1 contained in the prepared suspension had a number average particle size of 32 nm. The first shell resin precursor A-1 was a precursor of a hydrophobic thermosetting resin.

(Preparation of Suspension of First Shell Resin Precursor A-2)

A suspension of a first shell resin precursor A-2 was prepared according to the same method as for the first shell resin precursor A-1 in all aspects other than that the amount of styrene was changed from 14 mL to 17 mL and the amount of 2-hydroxyethyl methacrylate (HEMA) was changed from 4 mL to 1 mL. Particles of the first shell resin precursor A-2 contained in the prepared suspension had a number average particle size of 39 nm. The first shell resin precursor A-2 was a precursor of a hydrophobic thermosetting resin.

(Preparation of Suspension of First Shell Resin Precursor A-3)

A suspension of a first shell resin precursor A-3 was prepared according to the same method as for the first shell resin precursor A-1 in all aspects other than that the amount of styrene was changed from 14 mL to 8 mL and the amount of 2-hydroxyethyl methacrylate (HEMA) was changed from 4 mL to 10 mL. Particles of the first shell resin precursor A-3 contained in the prepared suspension had a number average particle size of 24 nm. The first shell resin precursor A-3 was a precursor of a hydrophobic thermosetting resin.

(Preparation of Suspension of First Shell Resin Precursor A-4)

A suspension of a first shell resin precursor A-4 was prepared according to the same method as for the first shell resin precursor A-1 in all aspects other than that the amount of styrene was changed from 14 mL to 15 mL, 4 mL of 2-hydroxyethyl acrylate (HEA) was used instead of 4 mL of 2-hydroxyethyl methacrylate (HEMA), and the amount of butyl acrylate was changed from 2 mL to 1 mL. Particles of the first shell resin precursor A-4 contained in the prepared suspension had a number average particle size of 34 nm. The first shell resin precursor A-4 was a precursor of a hydrophobic thermosetting resin.

(Preparation of Suspension of First Shell Resin Precursor A-5)

A suspension of a first shell resin precursor A-5 was prepared according to the same method as for the first shell resin precursor A-1 in all aspects other than that the amount of styrene was changed from 14 mL to 15 mL, 4 mL of 2-hydroxypropyl acrylate (HPA) was used instead of 4 mL of 2-hydroxyethyl methacrylate (HEMA), and the amount of butyl acrylate was changed from 2 mL to 1 mL. Particles of the first shell resin precursor A-5 contained in the prepared suspension had a number average particle size of 32 nm. The first shell resin precursor A-5 was a precursor of a hydrophobic thermosetting resin.

(Preparation of Suspension of First Shell Resin Precursor A-6)

A suspension of a first shell resin precursor A-6 was prepared according to the same method as for the first shell resin precursor A-1 in all aspects other than that the amount of styrene was changed from 14 mL to 15 mL, 4 mL of 2-hydroxypropyl methacrylate (HPMA) was used instead of 4 mL of 2-hydroxyethyl methacrylate (HEMA), and the amount of butyl acrylate was changed from 2 mL to 3 mL. Particles of the first shell resin precursor A-6 contained in the prepared suspension had a number average particle size of 43 nm. The first shell resin precursor A-6 was a precursor of a hydrophobic thermosetting resin.

(Preparation of Suspension of First Shell Resin Precursor A-7)

A suspension of a first shell resin precursor A-7 was prepared according to the same method as for the first shell resin precursor A-1 in all aspects other than that 2-hydroxyethyl methacrylate (HEMA) was not used and the amount of styrene was changed from 14 mL to 20 mL. Particles of the first shell resin precursor A-7 contained in the prepared suspension had a number average particle size of 45 nm. The first shell resin precursor A-7 was a precursor of a hydrophobic thermosetting resin.

(Preparation of Solution of First Shell Resin Precursor B-1)

First, 950 mL of ion exchanged water was added to a three-necked flask equipped with a thermometer and a stirring impeller, and having a capacity of 1 L. The internal temperature of the flask was subsequently increased to 80° C. using a water bath. Thereafter, a mixture of 12 ml of acrylamide and 8 mL of 2-hydroxyethyl methacrylate (HEMA) and, separately thereto, a solution of 0.5 g of potassium persulfate dissolved in 30 mL of ion exchanged water were dripped into the flask over 5 hours. The flask contents were maintained at 80° C. for 2 hours in order to allow polymerization of polymerizable monomers added to the flask. As a result, a first shell resin precursor B-1 was prepared. The first shell resin precursor B-1 was a precursor of a hydrophilic thermoplastic resin.

(Preparation of Solution of First Shell Resin Precursor B-2)

A solution of a first shell resin precursor B-2 was prepared according to the same method as for the first shell resin precursor B-1 in all aspects other than that the amount of acrylamide was changed from 12 mL to 14 mL and the amount of 2-hydroxyethyl methacrylate (HEMA) was changed from 8 mL to 6 mL. The first shell resin precursor B-2 was a precursor of a hydrophilic thermoplastic resin.

(Preparation of Solution of First Shell Resin Precursor B-3)

A solution of a first shell resin precursor B-3 was prepared according to the same method as for the first shell resin precursor B-1 in all aspects other than that the amount of acrylamide was changed from 12 mL to 10 mL and the amount of 2-hydroxyethyl methacrylate (HEMA) was changed from 8 mL to 10 mL. The first shell resin precursor B-3 was a precursor of a hydrophilic thermoplastic resin.

(Preparation of Solution of First Shell Resin Precursor B-4)

A solution of a first shell resin precursor B-4 was prepared according to the same method as for the first shell resin precursor B-1 in all aspects other than that 2-hydroxyethyl methacrylate (HEMA) was not used and the amount of acrylamide was changed from 12 mL to 20 mL. The first shell resin precursor B-4 was a precursor of a hydrophilic thermoplastic resin.

(Preparation of Suspension of First Shell Resin Precursor C-1)

A suspension of a first shell resin precursor C-1 was prepared according to the same method as for the first shell resin precursor A-1 in all aspects other than that divinylbenzene was not used. Particles of the first shell resin precursor C-1 contained in the prepared suspension had a number average particle size of 39 nm. The first shell resin precursor C-1 was a precursor of a hydrophobic thermoplastic resin.

(Preparation of Suspension of First Shell Resin Precursor C-2)

A suspension of a first shell resin precursor C-2 was prepared according to the same method as for the first shell resin precursor C-1 in all aspects other than that the amount of styrene was changed from 14 mL to 17 mL and the amount of 2-hydroxyethyl methacrylate (HEMA) was changed from 4 mL to 1 mL. Particles of the first shell resin precursor C-2 contained in the prepared suspension had a number average particle size of 32 nm. The first shell resin precursor C-2 was a precursor of a hydrophobic thermoplastic resin.

(Preparation of Suspension of First Shell Resin Precursor C-3)

A suspension of a first shell resin precursor C-3 was prepared according to the same method as for the first shell resin precursor C-1 in all aspects other than that the amount of styrene was changed from 14 mL to 8 mL and the amount of 2-hydroxyethyl methacrylate (HEMA) was changed from 4 mL to 10 mL. Particles of the first shell resin precursor C-3 contained in the prepared suspension had a number average particle size of 41 nm. The first shell resin precursor C-3 was a precursor of a hydrophobic thermoplastic resin.

(Preparation of Suspension of First Shell Resin Precursor C-4)

A suspension of a first shell resin precursor C-4 was prepared according to the same method as for the first shell resin precursor C-1 in all aspects other than that 2-hydroxyethyl methacrylate (HEMA) was not used and the amount of styrene was changed from 14 mL to 18 mL. Particles of the first shell resin precursor C-4 contained in the prepared suspension had a number average particle size of 40 nm. The first shell resin precursor C-4 was a precursor of a hydrophobic thermoplastic resin.

Particles of the first shell resin precursors A-1 to A-7 did not dissolve upon addition to tetrahydrofuran. The above experimental results were used to confirm that the first shell resin precursors A-1 to A-7 were each a precursor of a thermosetting resin. The first shell resin precursors C-1 to C-4 dissolved upon addition to tetrahydrofuran. The above experimental results were used to confirm that the first shell resin precursors C-1 to C-4 were each a precursor of a thermoplastic resin.

Example 1

Toner Core Preparation

An FM mixer (product of Nippon Coke & Engineering Co., Ltd.) was used to mix 750 g of a low viscosity polyester resin (product of Kao Corporation, Tg=38° C., Tm=65° C.), 100 g of a medium viscosity polyester resin (product of Kao Corporation, Tg=53° C., Tm=84° C.), 150 g of a high viscosity polyester resin (product of Kao Corporation, Tg=71° C., Tm=120° C.), 55 g of a releasing agent (carnauba wax, Carnauba Wax No. 1 produced by S. Kato & Co.), and 40 g of a colorant (Phthalocyanine Blue, KET Blue 111 produced by DIC Corporation) at 2,400 rpm. The resultant mixture was melt-kneaded using a twin-screw extruder (PCM-30 produced by Ikegai Corp.) under conditions of a material input rate of 5 kg/hour, a shaft rotational speed of 160 rpm, and a temperature setting range of 100° C. to 130° C. The resultant kneaded product was cooled and then coarsely pulverized using a pulverizer (Rotoplex (registered Japanese trademark) produced by Hosokawa Micron Corporation). Next, the coarsely pulverized product was finely pulverized using a jet mill (Model-I Supersonic Jet Mill produced by Nippon Pneumatic Mfg. Co., Ltd.). Thereafter, the finely pulverized product was classified using a classifier (Elbow Jet EJ-LABO produced by Nittetsu Mining Co., Ltd.). As a result, toner cores were obtained.

(Shell Layer Formation Process)

First, 300 mL of ion exchanged water was added to a three-necked flask equipped with a thermometer and a stirring impeller, and having a capacity of 1 L. The internal temperature of the flask was subsequently maintained at 30° C. using a water bath. Next, dilute hydrochloric acid was added into the flask to adjust the pH of an aqueous medium in the flask to 4. After pH adjustment, 150 mL of the suspension of the first shell resin precursor A-1 and 0.1 mL of an aqueous solution of a hexamethylol melamine prepolymer (MIRBANE (registered Japanese trademark) resin SM-607 produced by Showa Denko K.K., solid concentration 80% by mass) were added into the flask as raw materials for shell layers. The shell layer raw materials (in particular the hexamethylol melamine) were dissolved in the aqueous medium to prepare an aqueous solution of the shell layer raw materials. Next, 300 g of the toner cores were added to the prepared aqueous solution. Thereafter, the flask contents were stirred for 1 hour at a rotational speed of 200 rpm. Next, 300 mL of ion exchanged water was added into the flask. Thereafter, the internal temperature of the flask was increased to 70° C. at a rate of 1° C./minute while stirring the flask contents at a rotational speed of 100 rpm. After heating, the flask contents were stirred continuously for 2 hours at 70° C. at a rotational speed of 100 rpm. Thereafter, sodium hydroxide was added into the flask to adjust the pH of the flask contents to 7. Next, the flask contents were cooled to room temperature (approximately 25° C.) to yield a toner mother particle-containing dispersion.

(Washing Step)

A wet cake of toner mother particles was collected from the toner mother particle-containing dispersion using a Buchner funnel. The toner mother particles were then washed by re-dispersing the wet cake of the toner mother particles in ion exchanged water. The toner mother particles were washed five times with ion exchanged water as described above.

(Drying Step)

A slurry was prepared by dispersing the washed wet cake of the toner mother particles in 50% by mass concentration aqueous ethanol solution. The prepared slurry was fed into a continuous type surface modifier (Coatmizer (registered Japanese trademark) produced by Freund Corporation) to dry the toner mother particles in the slurry, yielding dry toner mother particles. Drying was carried out at a hot air temperature of 45° C. and a flow rate of 2 $m^3$/minute.

(External Addition Step)

An FM mixer (product of Nippon Coke & Engineering Co., Ltd.) having a capacity of 10 L was used to mix 100 parts by mass of the toner mother particles resulting from the drying step and 1.0 parts by mass of dry silica (AEROSIL (registered Japanese trademark) REA90 produced by Nippon Aerosil Co., Ltd.) for 5 minutes to cause external additive to adhere to the surfaces of the toner mother particles. Thereafter, the resultant toner was sifted using a 200 mesh (opening 75 μm) sieve to yield a toner of Example 1.

Example 2

A toner of Example 2 was prepared according to the same method as the toner of Example 1 in all aspects other than that the amount of methylol melamine aqueous solution in the shell layer formation process was changed from 0.1 mL to 0.05 mL.

Example 3

A toner of Example 3 was prepared according to the same method as the toner of Example 1 in all aspects other than that the amount of methylol melamine aqueous solution in the shell layer formation process was changed from 0.1 mL to 0.5 mL.

Example 4

A toner of Example 4 was prepared according to the same method as the toner of Example 1 in all aspects other than that 150 mL of the first shell resin precursor A-2 was used instead of 150 mL of the first shell resin precursor A-1 in the shell layer formation process.

Example 5

A toner of Example 5 was prepared according to the same method as the toner of Example 1 in all aspects other than that 150 mL of the first shell resin precursor A-3 was used instead of 150 mL of the first shell resin precursor A-1 in the shell layer formation process.

Example 6

A toner of Example 6 was prepared according to the same method as the toner of Example 1 in all aspects other than that 150 mL of the first shell resin precursor A-4 was used instead of 150 mL of the first shell resin precursor A-1 in the shell layer formation process.

Example 7

A toner of Example 7 was prepared according to the same method as the toner of Example 1 in all aspects other than that 150 mL of the first shell resin precursor A-5 was used instead of 150 mL of the first shell resin precursor A-1 in the shell layer formation process.

Example 8

A toner of Example 8 was prepared according to the same method as the toner of Example 1 in all aspects other than that 150 mL of the first shell resin precursor A-6 was used instead of 150 mL of the first shell resin precursor A-1 in the shell layer formation process.

Example 9

A toner of Example 9 was prepared according to the same method as the toner of Example 1 in all aspects other than that 150 mL of the first shell resin precursor B-1 was used instead of 150 mL of the first shell resin precursor A-1 in the shell layer formation process.

Example 10

A toner of Example 10 was prepared according to the same method as the toner of Example 9 in all aspects other than that the amount of methylol melamine aqueous solution in the shell layer formation process was changed from 0.1 mL to 0.05 mL.

Example 11

A toner of Example 11 was prepared according to the same method as the toner of Example 9 in all aspects other than that the amount of methylol melamine aqueous solution in the shell layer formation process was changed from 0.1 mL to 0.5 mL.

Example 12

A toner of Example 12 was prepared according to the same method as the toner of Example 11 in all aspects other than that 150 mL of the first shell resin precursor B-2 was used instead of 150 mL of the first shell resin precursor B-1 in the shell layer formation process.

Example 13

A toner of Example 13 was prepared according to the same method as the toner of Example 11 in all aspects other than that 150 mL of the first shell resin precursor B-3 was used instead of 150 mL of the first shell resin precursor B-1 in the shell layer formation process.

Example 14

A toner of Example 14 was prepared according to the same method as the toner of Example 1 in all aspects other than that 150 mL of the first shell resin precursor C-1 was used instead of 150 mL of the first shell resin precursor A-1 in the shell layer formation process.

Example 15

A toner of Example 15 was prepared according to the same method as the toner of Example 14 in all aspects other than that the amount of methylol melamine aqueous solution in the shell layer formation process was changed from 0.1 mL to 0.05 mL.

Example 16

A toner of Example 16 was prepared according to the same method as the toner of Example 14 in all aspects other than that the amount of methylol melamine aqueous solution in the shell layer formation process was changed from 0.1 mL to 0.5 mL.

Example 17

A toner of Example 17 was prepared according to the same method as the toner of Example 16 in all aspects other than that 150 mL of the first shell resin precursor C-2 was used instead of 150 mL of the first shell resin precursor C-1 in the shell layer formation process.

Example 18

A toner of Example 18 was prepared according to the same method as the toner of Example 16 in all aspects other than that 150 mL of the first shell resin precursor C-3 was used instead of 150 mL of the first shell resin precursor C-1 in the shell layer formation process.

Comparative Example 1

A toner of Comparative Example 1 was prepared according to the same method as the toner of Example 1 in all aspects other than that 150 mL of the first shell resin precursor A-7 was used instead of 150 mL of the first shell resin precursor A-1 in the shell layer formation process.

Comparative Example 2

A toner of Comparative Example 2 was prepared according to the same method as the toner of Example 1 in all aspects other than that 150 mL of the first shell resin precursor B-4 was used instead of 150 mL of the first shell resin precursor A-1 in the shell layer formation process.

Comparative Example 3

A toner of Comparative Example 3 was prepared according to the same method as the toner of Example 1 in all aspects other than that 150 mL of the first shell resin precursor C-4 was used instead of 150 mL of the first shell resin precursor A-1 in the shell layer formation process.

[Evaluation Method]

The following explains an evaluation method of each sample (toners of Examples 1-18 and Comparative Examples 1-3).

(High-Temperature Preservability)

A 20 mL polyethylene container containing 2 g of the sample (toner) was left for 3 hours in a thermostatic chamber set to 60° C. Thereafter, the container was taken out of the thermostatic chamber and cooled to prepare a toner for evaluation use in the container. Next, the evaluation toner was placed on a 100 mesh (opening 150 μm) sieve of known mass. The mass of the sieve containing the evaluation toner was measured in order to obtain the mass of the toner prior to sifting. Next, the sieve was set in a powder tester (product of Hosokawa Micron Corporation) and was caused to vibrate in accordance with a manual of the powder tester at a rheostat level of 5 for 30 seconds in order to sift the evaluation toner. After sifting, the mass of toner that did not pass through the sieve (i.e., toner remaining on the sieve) was measured. The mass of the toner pre-sifting and the mass of toner post-sifting (i.e., the mass of toner that did not pass through the sieve) were used to calculate a degree of aggregation (units: % by mass) based on the following equation.

$$\text{Degree of aggregation} = 100 \times \text{toner mass post-sifting} / \text{toner mass pre-sifting}$$

High-temperature preservability of the sample (toner) was evaluated based on the calculated degree of aggregation, in accordance with the following standard.

Good: Degree of aggregation of no greater than 50% by mass

Poor: Degree of aggregation of greater than 50% by mass (Low-Temperature Fixability)

A developer (two-component developer) for evaluation use was prepared by mixing a developer carrier (carrier for TASKalfa5550ci produced by KYOCERA Document Solutions Inc.) and 10% by mass of the toner relative to the mass of the carrier for 30 minutes using a ball mill.

A color printer (FS-C5250DN produced by KYOCERA Document Solutions Inc., modified to form a testing apparatus having adjustable fixing temperature) having a roller-roller type heat pressure fixing device (nip width 8 mm) was used as a testing apparatus. The evaluation developer (two-component developer) prepared as described above was loaded into a developing device of the evaluation apparatus and the sample (toner) was loaded into a toner container of the evaluation apparatus.

In order to evaluate fixability of the sample (toner), the evaluation apparatus was used to form a solid image with a size of 25 mm×25 mm and a coverage of 100% on 90 g/m$^2$ paper (A4 size printing paper) under conditions of a linear speed of 200 mm/s (nip passage time 40 ms) and a toner application amount of 1.0 mg/cm$^2$. Next, the paper having the image formed thereon was passed through the fixing device. The fixing temperature was set in a range of 100° C. to 200° C. More specifically, the fixing temperature of the fixing device was gradually increased from 100° C. to measure the minimum temperature at which the toner (solid image) could be fixed to the paper (minimum fixing temperature).

In measurement of the minimum fixing temperature, fixing of the toner was confirmed by a folding and rubbing test such as described below. More specifically, the paper was folded in half such that the surface on which the image was formed was folded inward and a 1 kg weight covered with cloth was rubbed back and forth ten times on the fold. Next, the paper was opened out to observe a folded portion of the paper (portion on which the solid image was formed). The length of peeling of the toner (peeling length) in the folded portion was measured. The minimum fixing temperature was determined to be a lowest temperature among fixing temperatures for which the peeling length was less than 1 mm. Low-temperature fixability of the sample (toner) was evaluated based on the measured minimum fixing temperature, in accordance with the following standard.

Good: Minimum fixing temperature of no greater than 160° C.

Poor: Minimum fixing temperature of greater than 160° C.

(Durability)

A developer (two-component developer) for evaluation use was prepared by mixing a sample (toner) and a developer carrier produced by Powdertech Co., Ltd. (volume resistivity $10^7$ Ω·cm, saturation magnetization 70 emu/g, number average particle size 35 μm) for 30 minutes using a ball mill. A ratio of the toner relative to the overall mass of the developer was 12% by mass.

A color multifunction peripheral (TASKalfa 5550ci produced by KYOCERA Document Solutions Inc.) was used as an evaluation apparatus. The evaluation developer (two-component developer) prepared as described above was loaded into a developing device of the evaluation apparatus and the sample (toner) was loaded into a toner container of the evaluation apparatus.

A durability test was carried out by using the evaluation apparatus to print 10,000 sheets with a coverage of 5% at an ambient temperature of 20° C. and an ambient relative humidity of 60%. Voltage between a development sleeve and a magnet roll was adjusted to 200 V to 300 V such that initial image density (value measured using a reflectance densitometer) was at least 1.0 and no greater than 1.2. The image density was measured using a reflectance densitometer (SpectroEye (registered Japanese trademark) produced by X-Rite Inc.).

After the durability test, the mass of scattered toner in the evaluation apparatus was measured. The mass of scattered toner was evaluated according to the following standard.

Good: Mass of scattered toner of no greater than 100 mg

Poor: Mass of scattered toner of greater than 100 mg

Also, the amount of oppositely charged toner (units: % by mass) relative to the overall amount of toner was measured for the toner after the durability test using a particle size and electrostatic charge distribution analyzer (E-spart Analyzer EST-G produced by Hosokawa Micron Corporation). The measured amount (mass ratio) of oppositely charge toner was evaluated according to the following standard.

Good: Amount of oppositely charged toner of no greater than 1% by mass

Poor: Amount of oppositely charged toner of greater than 1% by mass

The charge of the toner in the developing device after the durability test was measured using a Q/m meter (MODEL 210HS-2A produced by Trek, Inc.). The measured charge of the toner was evaluated according to the following standard.

Good: Toner charge of at least 15 μC/g

Poor: Toner charge of less than 15 μC/g

[Evaluation Results]

Evaluation results for each of the samples (toners of Examples 1-18 and Comparative Examples 1-3) are shown below.

Figure 9:
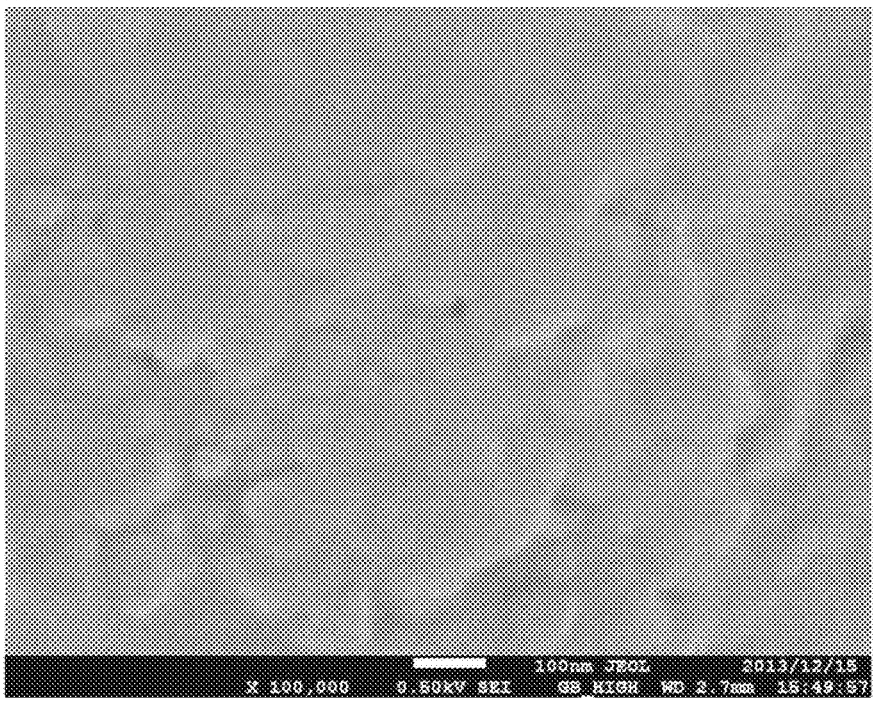
FIG. 9 is a scanning electron microscope photograph of the surface of a toner particle in a toner according to an embodiment of the present disclosure.
Figure 10:
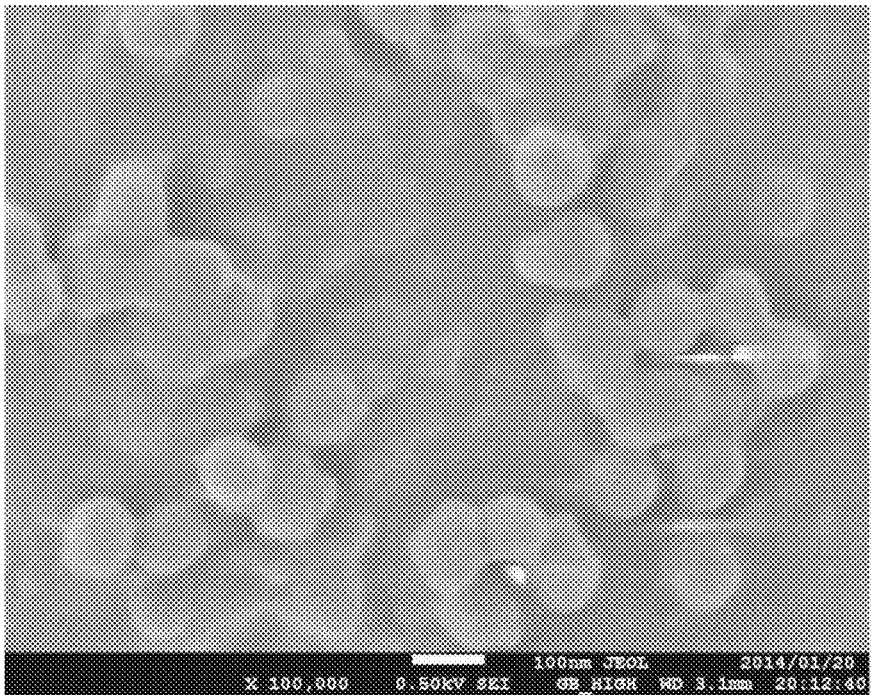
FIG. 10 Related Art
FIG. 10 is a scanning electron microscope photograph of the surface of a toner particle in a toner according to a comparative example.

Evaluation results relating to compatibility of the first shell resin and the second shell resin in the shell layers of the toner particles included in each sample (toner) are explained with reference to FIGS. 9 and 10. FIG. 9 is a photograph (scanning electron microscope (SEM) photograph) of a toner particle in the toner of Example 1 captured using a scanning electron microscope. The photograph in FIG. 9 was captured under SEM conditions of an accelerating voltage of 0.50 kV, a WD (working distance) of 2.7 mm, and a magnification of ×100,000. FIG. 10 is a photograph (SEM photograph) of a toner particle in the toner of Comparative Example 1 captured using the scanning electron microscope. The photograph in FIG. 10 was captured under SEM conditions of an accelerating voltage of 0.50 kV, a WD (working distance) of 3.1 mm, and a magnification of ×100,000

FIG. 9 illustrates that in the shell layers of the toner particles included in the toner of Example 1, the first shell resin and the second shell resin had high compatibility.

FIG. 10 illustrates that in the shell layers of the toner particles included in the toner of Comparative Example 1, the first shell resin and the second shell resin had low compatibility.

Table 3 shows evaluation results of high-temperature preservability, low-temperature fixability, and durability for each of the toners of Examples 1-18 and Comparative Examples 1-3.

TABLE 3

| | High-temperature preservability [% by mass] | Low-temperature fixability [° C.] | Durability | | |
|---|---|---|---|---|---|
| | | | Scattering amount [mg] | Charge [μC/g] | Opposite charging [% by mass] |
| Example 1 | 6 | 152 | 38 | 27 | 0.12 |
| Example 2 | 21 | 150 | 43 | 20 | 0.22 |
| Example 3 | 4 | 158 | 38 | 27 | 0.10 |
| Example 4 | 2 | 158 | 84 | 17 | 0.49 |
| Example 5 | 37 | 149 | 32 | 21 | 0.18 |
| Example 6 | 27 | 150 | 70 | 22 | 0.20 |
| Example 7 | 42 | 158 | 42 | 23 | 0.39 |
| Example 8 | 34 | 156 | 35 | 19 | 0.42 |
| Example 9 | 36 | 140 | 46 | 25 | 0.20 |
| Example 10 | 43 | 139 | 60 | 24 | 0.32 |
| Example 11 | 10 | 145 | 58 | 27 | 0.13 |
| Example 12 | 30 | 158 | 34 | 37 | 0.42 |
| Example 13 | 49 | 143 | 52 | 30 | 0.21 |
| Example 14 | 45 | 146 | 32 | 19 | 0.18 |
| Example 15 | 49 | 142 | 31 | 18 | 0.25 |
| Example 16 | 16 | 152 | 40 | 22 | 0.18 |
| Example 17 | 30 | 158 | 48 | 21 | 0.31 |
| Example 18 | 48 | 148 | 20 | 25 | 0.41 |
| Comparative Example 1 | 2 | 172 (Poor) | 624 (Poor) | 5 (Poor) | 6.24 (Poor) |
| Comparative Example 2 | 29 | 160 | 174 (Poor) | 11 (Poor) | 1.52 (Poor) |
| Comparative Example 3 | 21 | 159 | 523 (Poor) | 7 (Poor) | 5.21 (Poor) |

As shown in Table 3, the toners of examples 1-18 had excellent low-temperature fixability, high-temperature preservability, and durability.

What is claimed is:

1. An electrostatic latent image developing toner comprising toner particles that each include a toner core and a shell layer disposed over a surface of the toner core, wherein the shell layer contains a first shell resin and a second shell resin, the first shell resin is a hydrophilic thermoplastic resin, a hydrophobic thermoplastic resin, or a hydrophobic thermosetting resin, the second shell resin is a hydrophilic thermosetting resin, and the first shell resin includes a repeating unit that has an alcoholic hydroxyl group.

2. The electrostatic latent image developing toner according to claim 1, wherein the repeating unit having the alcoholic hydroxyl group is a repeating unit originating from 2-hydroxyalkyl (meth)acrylate.

3. The electrostatic latent image developing toner according to claim 2, wherein the 2-hydroxyalkyl (meth)acrylate is 2-hydroxyethyl acrylate, 2-hydroxypropyl acrylate, 2-hydroxyethyl methacrylate, or 2-hydroxypropyl methacrylate.

4. The electrostatic latent image developing toner according to claim 1, wherein the hydrophilic thermosetting resin is one or more resins selected from the group consisting of a melamine resin, a urea resin, and a glyoxal resin.

5. The electrostatic latent image developing toner according to claim 1, wherein the first shell resin is the hydrophobic thermoplastic resin, and in the shell layer, blocks substantially composed of the first shell resin are connected to one another via a junction portion substantially composed of the second shell resin.

6. The electrostatic latent image developing toner according to claim 1, wherein in the shell layer, the first shell resin and the second shell resin are in a reacted state via the repeating unit having the alcoholic hydroxyl group, through a transesterification reaction or an etherification reaction.

* * * * *